US006852149B2

(12) United States Patent
Huang

(10) Patent No.: US 6,852,149 B2
(45) Date of Patent: Feb. 8, 2005

(54) ELECTROSTATIC PRECIPITATOR

(75) Inventor: Ping Huang, Tainan Hsien (TW)

(73) Assignee: Hung Hsing Electric Co., Ltd., Tainan Hsien (TW)

( * ) Notice: Subject to any disclaimer, the term of this patent is extended or adjusted under 35 U.S.C. 154(b) by 9 days.

(21) Appl. No.: 10/452,505

(22) Filed: Jun. 3, 2003

(65) Prior Publication Data

US 2004/0244592 A1 Dec. 9, 2004

(51) Int. Cl.[7] ..... B03C 3/47
(52) U.S. Cl. ..... 96/79; 96/86; 96/87; 96/100
(58) Field of Search ..... 96/79, 83, 86, 96/87, 100

(56) References Cited

U.S. PATENT DOCUMENTS 3,018,844 A * 1/1962 Gonzalez ..... 96/86
3,581,470 A * 6/1971 Aitkenhead et al. ..... 96/79
3,836,135 A * 9/1974 Wightman ..... 269/43
4,231,766 A * 11/1980 Spurgin ..... 96/79
4,290,788 A * 9/1981 Pittman et al. ..... 96/86
5,137,552 A * 8/1992 Sasaki ..... 96/80
5,433,772 A * 7/1995 Sikora ..... 96/87
5,547,496 A * 8/1996 Hara ..... 96/79
6,096,119 A * 8/2000 Ho et al. ..... 96/79

FOREIGN PATENT DOCUMENTS

GB 986410 * 3/1965 ..... 96/87

* cited by examiner

*Primary Examiner*—Richard L. Chiesa
(74) *Attorney, Agent, or Firm*—Rosenberg, Klein & Lee

(57) ABSTRACT

An electrostatic precipitator includes several dividable supporting rods, which are passed through corresponding big holes, and tightly fitted in corresponding small holes of metallic boards so as to support the metallic boards equidistantly spaced apart in position. Each supporting rod is made of several connectable parts, each of which has an insertion end portion, and a hollow holding end portion. Each supporting rod is assembled by means of joining insertion end portions to adjacent hollow holding end portions, and is apart from the edges of corresponding big holes of the metallic boards. Thus, the metallic boards are firmly held in position by means of tops of hollow holding end portions of those connectable parts that are joined to small through holes thereof.

2 Claims, 7 Drawing Sheets

ELECTROSTATIC PRECIPITATOR

BACKGROUND OF THE INVENTION

1. Field of the Invention

The present invention relates to an electrostatic precipitator, more particularly one, which is relatively simple in structure, relatively inexpensive to manufacture, and easy to assemble.

2. Brief Description of the Prior Art

Referring to FIGS. 7, and 8, a conventional electrostatic precipitator consists of upper and lower aluminum boards 45, 46, long metallic boards 41 equidistantly spaced apart between the aluminum boards 45, 46, short metallic boards 42, which are equidistantly spaced apart, and each of which is positioned between two adjacent long metallic boards 41, 41, and metallic rods 43, 44 joined to the aluminum boards 45, 46 at two ends for supporting the metallic boards 41, 42 in position.

The long metallic boards 41 are provided for positive charges to be deposited on. Each long metallic board 41 is formed with several big through holes 411, and small through holes (not numbered) smaller than the big ones 411. The short metallic boards 42 are provided for negative charges to be deposited on. Each short metallic board 42 is formed with big through holes 421, and small through holes (not numbered) smaller than the big ones 421. The big through holes 411 are aligned with corresponding small through holes of the short boards 42 while the big through holes 421 are aligned with corresponding small through holes of the long boards 41.

The metallic rods 43 are passed through corresponding small holes of the long metallic boards 41, and corresponding big holes 421 of the short metallic boards 42; the metallic rods 43 are apart from the edges of corresponding big holes 421 of the short metallic boards 42, and tightly contact the edges of corresponding small holes of the long metallic boards 41. Sleeves 431 are passed around each metallic rod 43, and are each positioned between two adjacent long boards 41 so as to prevent distance between the adjacent long boards 41 from changing; thus, the long metallic boards 41 are securely and equidistantly spaced apart, and electrically connected to the metallic rods 43. Each metallic rod 43 is joined to insulating sleeves 451, 461 at two end portions thereof. The insulating sleeves 451, 461 are passed into corresponding ones of holes formed on the upper and the lower aluminum boards 45, 46. And, nuts 451, 452 are screwed onto upper and lower ends of each metallic rod 43.

The metallic rods 44 are passed through corresponding big holes 411 of the long metallic boards 41, and corresponding small holes of the short metallic boards 42; the metallic rods 44 are apart from the edges of corresponding big holes 411 of the long metallic boards 41, and tightly contact the edges of corresponding small holes of the short metallic boards 42. Sleeves 441 are passed around each metallic rod 44, and are each positioned between two adjacent short boards 42 so as to prevent distance between the adjacent short boards 42 from changing; thus, the short metallic boards 42 are securely and equidistantly spaced apart, and electrically connected to the metallic rods 44. Each metallic rod 44 is joined to insulating sleeves at two end portions thereof. The insulating sleeves are passed into corresponding ones of holes formed on the upper and the lower aluminum boards 45, 46. And, nuts are screwed onto upper and lower ends of each metallic rod 44.

Thus, positive charges can be deposited on the long metallic boards 41 via the metallic rods 43, and negative charges on the short ones 42 via the metallic rods 44. When dust in the air is made to have positive charges thereon, and passed through the electrostatic precipitator, the dust will be attracted to the short metallic boards 41, and in turns, air is cleaned.

However, metallic rods 43, 44 have to be used together with insulating sleeves 451, 461 so as to hold and space the metallic boards 41, 42 in position. In other words, two different forms of parts have to be used as the supporting and spacing mechanism for the metallic boards on the above electrostatic precipitator. Consequently, the electrostatic precipitator is relatively expensive to manufacture, and labor-costing to assemble.

SUMMARY OF THE INVENTION

It is a main object of the present invention to provide an electrostatic precipitator, more particularly one, which is relatively simple in structure, inexpensive to manufacture, and easy to assemble.

The electrostatic precipitator of the present invention includes several dividable supporting rods, which are passed through corresponding big holes, and tightly fitted in corresponding small holes of metallic boards so as to support the metallic boards equidistantly spaced apart in position. Each supporting rod is made of several connectable parts, each of which has an insertion end portion, and a hollow holding end portion. Each supporting rod is assembled by means of joining insertion end portions to adjacent hollow holding end portions, and is apart from the edges of corresponding big holes of the metallic boards. Thus, the metallic boards are firmly held in position by means of tops of hollow holding end portions of those connectable parts that are joined to small through holes thereof.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
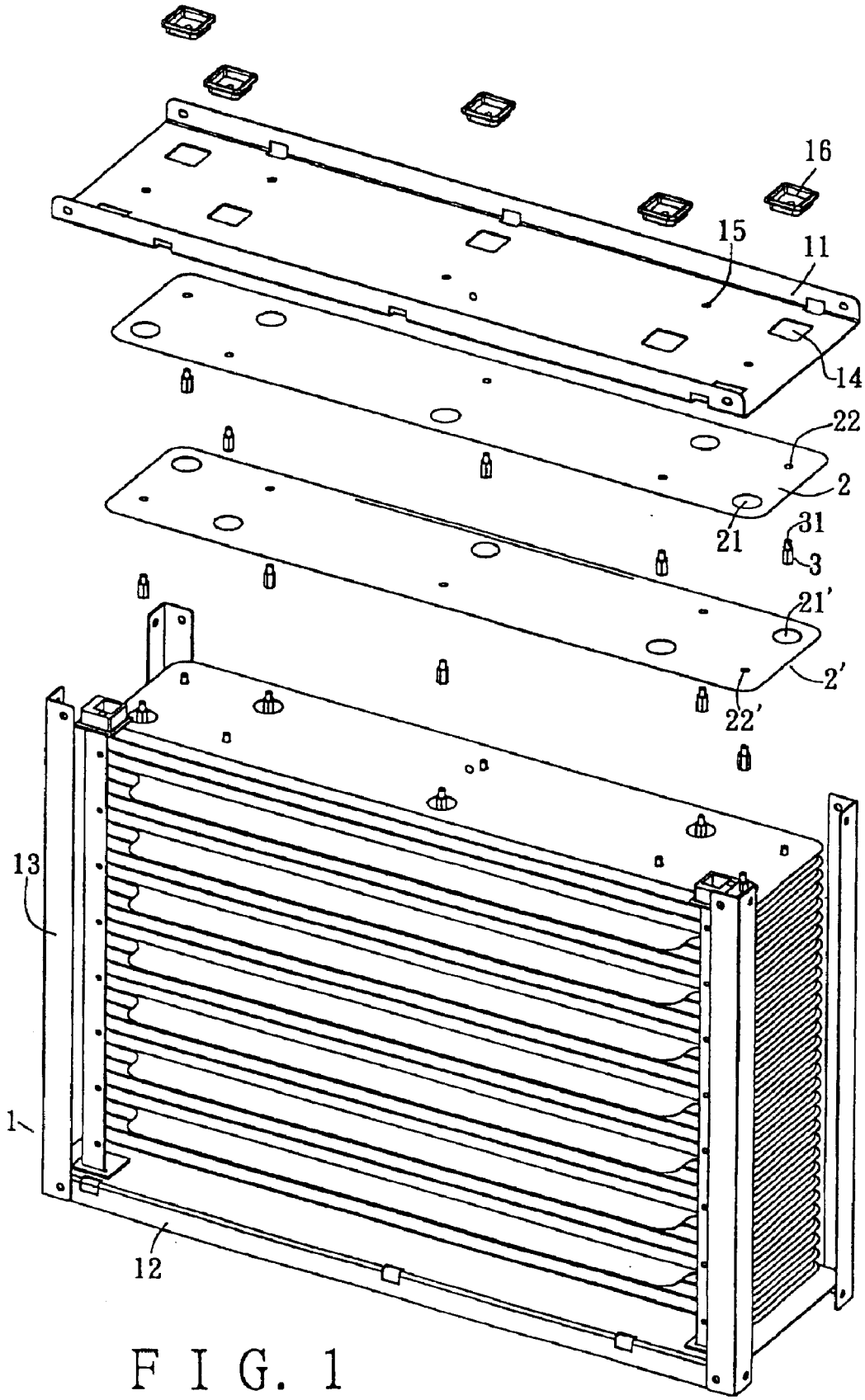
FIG. 1 is an exploded perspective view of the electrostatic precipitator according to the present invention.
Figure 2:
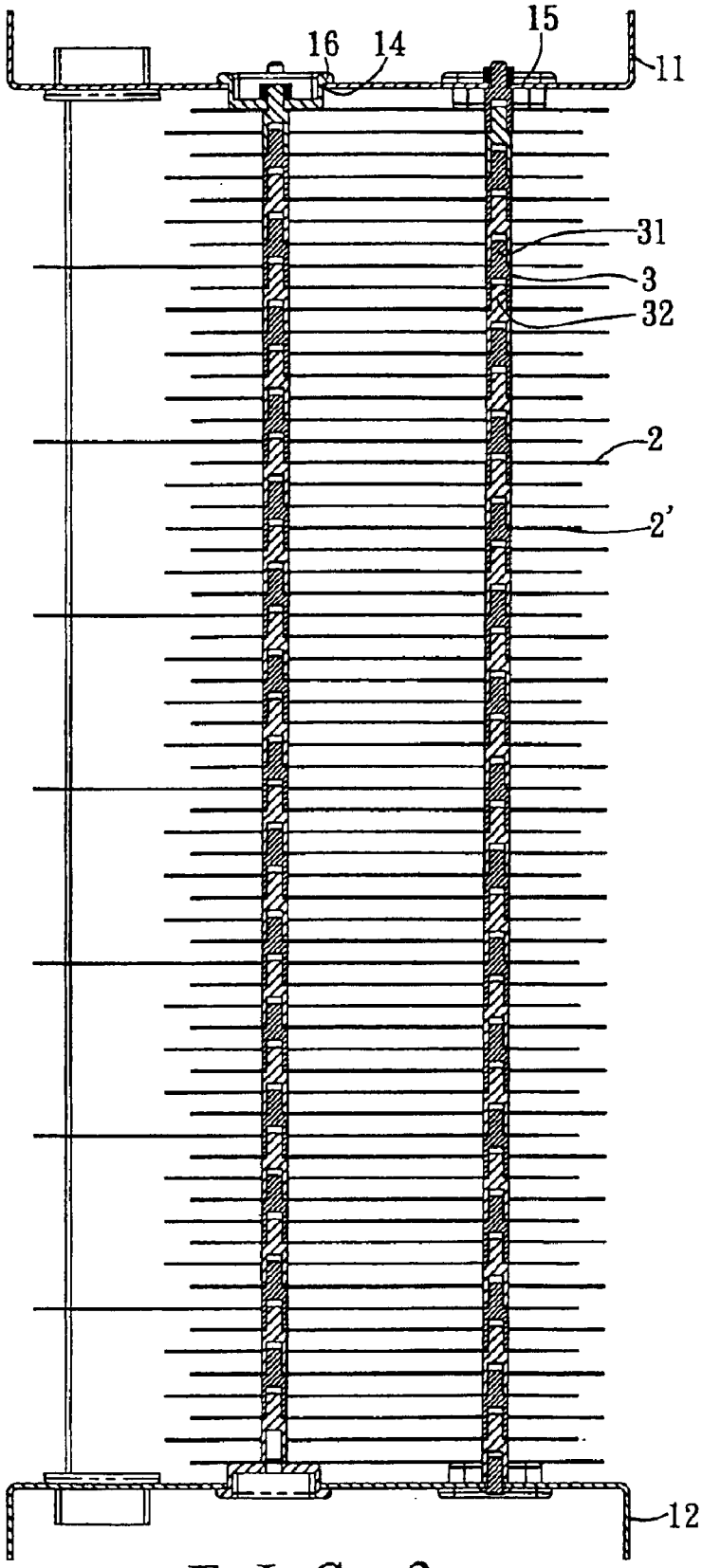
FIG. 2 is a vertical cross-sectional view of the electrostatic precipitator according to the present invention.
Figure 3:
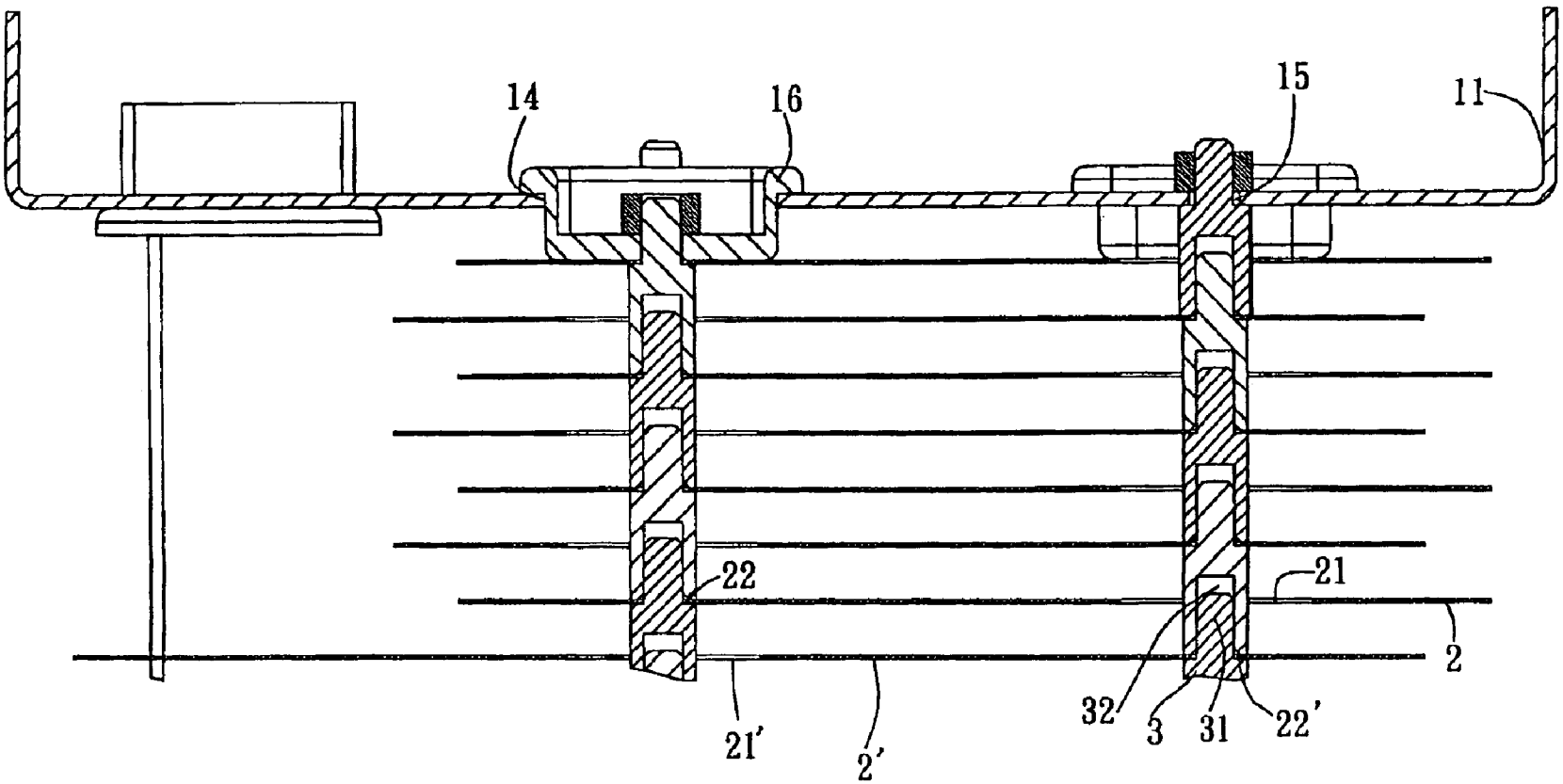
FIG. 3 is a partial vertical cross-sectional view of the electrostatic precipitator of the present invention.

Referring to FIGS. 1 to 3, a preferred embodiment of an electrostatic precipitator in the present invention includes a frame 1, first and second kinds of metallic boards 2, 2' and dividable metallic supporting rods each comprised of several connectable parts 3.

The frame 1 consists of upper and lower board parts 11, 12, and four vertical rod parts 13, which are joined to respective ones of the corners of the board parts 11, 12 to support the board parts 11, 12 in position. Each of the board parts 11, 12 has connecting holes 14, and engaging holes 15 smaller than the connecting holes 14. Caps 16 are tightly fitted in the connecting holes 14 of the board parts 11, and are each formed with a middle engaging hole (not numbered).

The first kind of metallic boards 2 are provided for positive charges to be deposited on, and are spaced apart between upper and lower board parts 11, 12 of the frame 1. Each first kind of metallic board 2 is formed with several big through holes 21, and small through holes 22 smaller than the big ones 21. The second kind of metallic boards 2' are provided for negative charges to be deposited on, and are spaced apart, each being positioned between two adjacent first kind of metallic boards 2. Each second kind of metallic board 2' is formed with several big through holes 21', and small through holes 22' smaller than the big ones 21'. The big through holes 21 are aligned with corresponding small through holes 22' while the small through holes 22 are aligned with corresponding big through holes 21', allowing the dividable supporting rods to be passed through the metallic boards 2, 2'. Furthermore, the engaging holes 15 of the frame 1 are aligned with corresponding through holes 21, 22' while the connecting holes 14 of the frame 1 are aligned with corresponding through holes 22, 21' so that the dividable supporting rods can be passed through the upper and lower board parts 11, 12 of the frame 1.

The dividable metallic supporting rods are provided for supporting the metallic boards 2, 2' in position, and for making the metallic boards 2, 2' equidistantly spaced apart. Each connectable part 3 of the dividable supporting rods includes an insertion end portion 31, and a hollow holding portion, which is thicker than the insertion end portion 31, and which has a connecting hole 32; the insertion end portions 31 are formed with such a size as to be capable of being tightly fitted into the connecting holes 32, the small through holes 22, 22', and the engaging holes 15.

Figure 4:
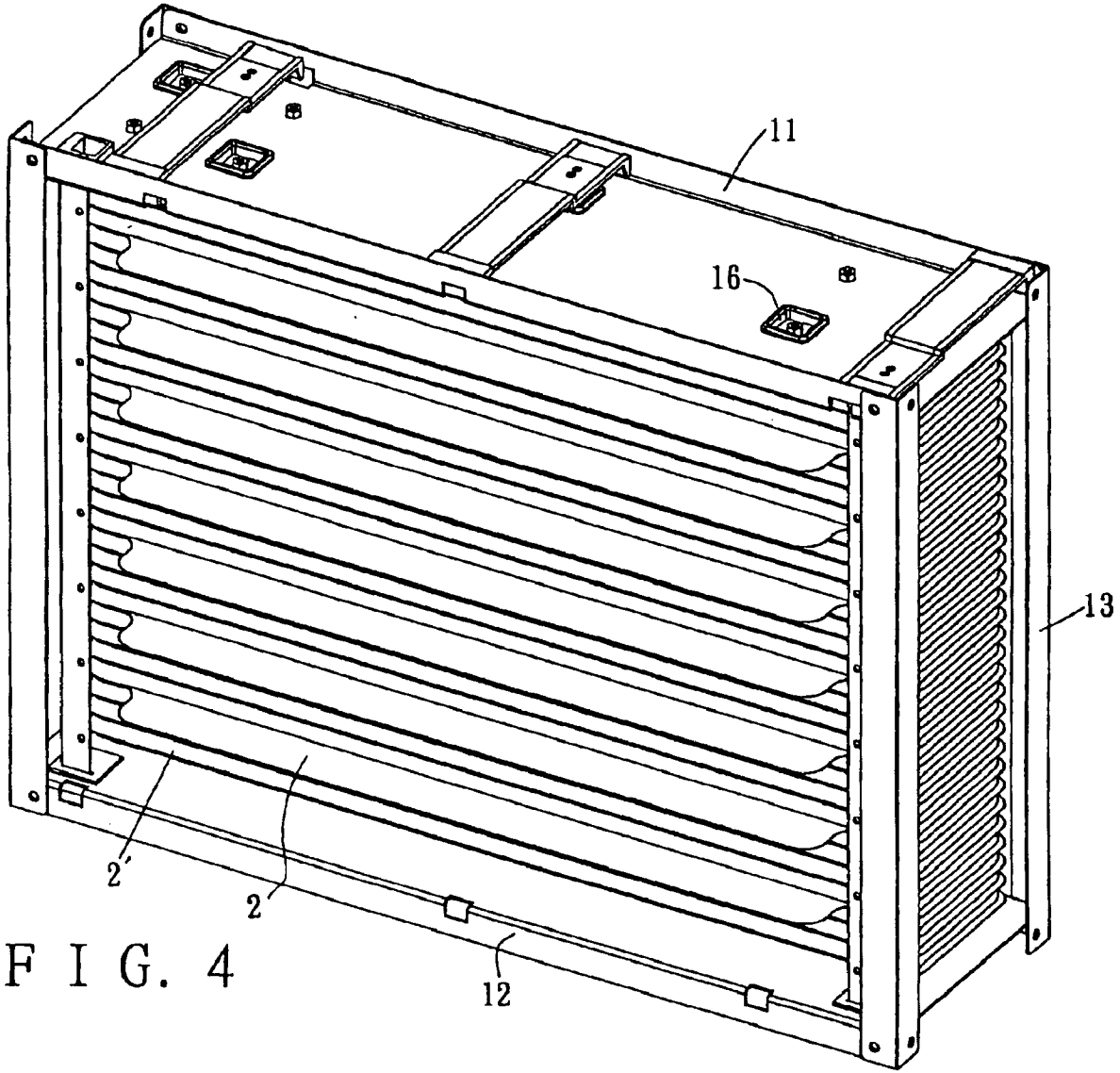
FIG. 4 is a perspective view of the electrostatic precipitator according to the present invention.

To assemble the electrostatic precipitator, referring to FIGS. 2 to 4, firstly, one connectable part 3 is securely disposed on each of the holes 14, and 15 of the lower board part 12. Secondly, one first kind of metallic board 2 is joined to the mentioned connectable parts 3 with the small through holes 22 thereof being tightly fitted around corresponding insertion end portions 31, and with the edges of the big through holes 21 being apart from corresponding connectable parts 3; thus, the above mentioned metallic board 2 is supported in position by means of those connectable parts 3 that are joined to the small through holes 22 thereof. Thirdly, one connectable part 3 is joined to each of the connectable parts 3 used in the first step above, with hollow holding portion thereof, which is formed with connecting hole 32, being tightly mounted over corresponding insertion end portion 31. Fourthly, one second kind of metallic board 2' is joined to the connectable parts 3 used in the third step above, with the small through holes 22' thereof being tightly fitted around corresponding insertion end portions 31, and with the edges of the big through holes 21' being apart from corresponding connectable parts 3; thus, the second kind of metallic board 2' is supported in position. Then, connectable parts 3, one first kind of metallic board 2, connectable parts 3, one second kind of metallic board 2' and so on are fitted in position in sequence in the way mentioned above. And, uppermost connectable parts 3 are tightly passed through the engaging holes 15, and the engaging holes of the caps 16; thus, the supporting rods are fixedly joined to the frame 1 so as to secure the equidistantly spaced apart metallic boards 2, 2' in position.

Figure 5:
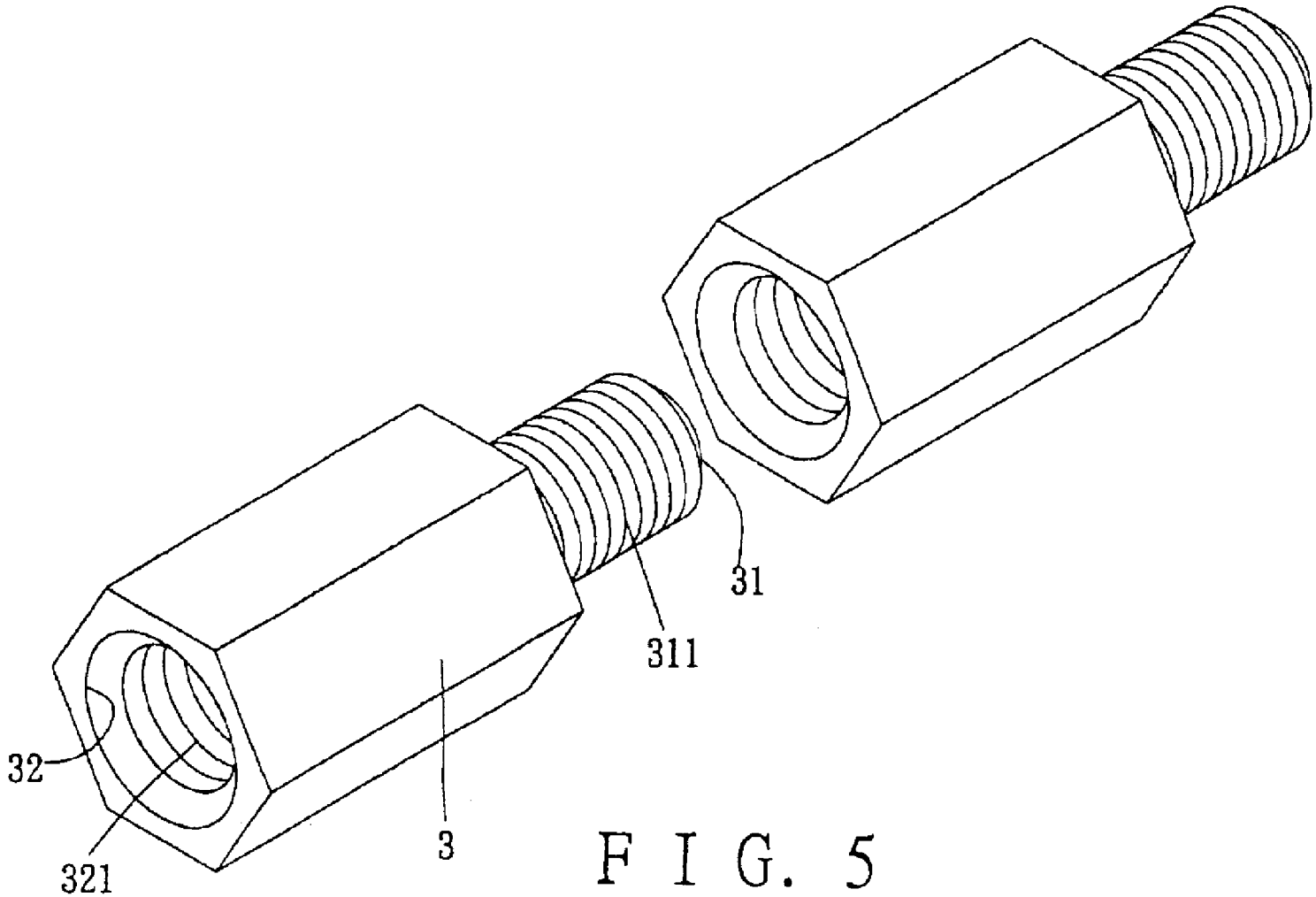
FIG. 5 is a partial exploded perspective view of a supporting rod of the electrostatic precipitator of the present embodiment.
Figure 6:
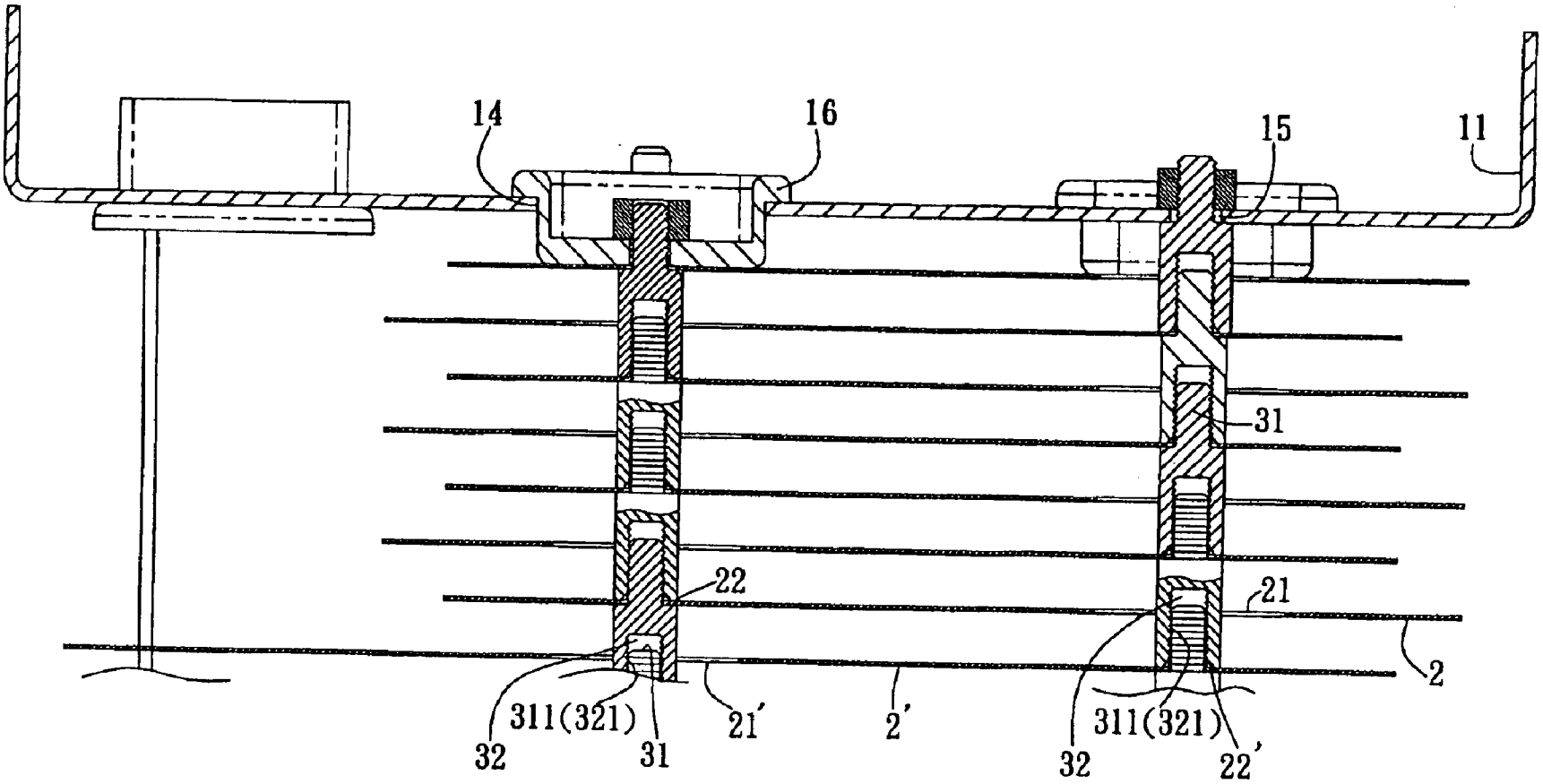
FIG. 6 is a partial vertical cross-sectional view of the electrostatic precipitator of the present embodiment.
Figure 8:
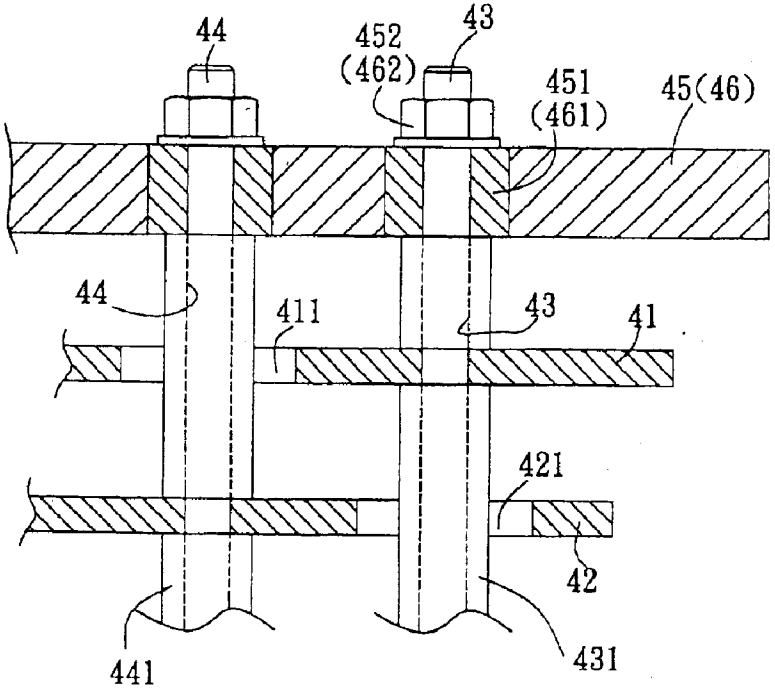
FIG. 8 (PRIOR ART)
FIG. 8 is a partial vertical cross-sectional view of the conventional electrostatic precipitator.
Figure 7:
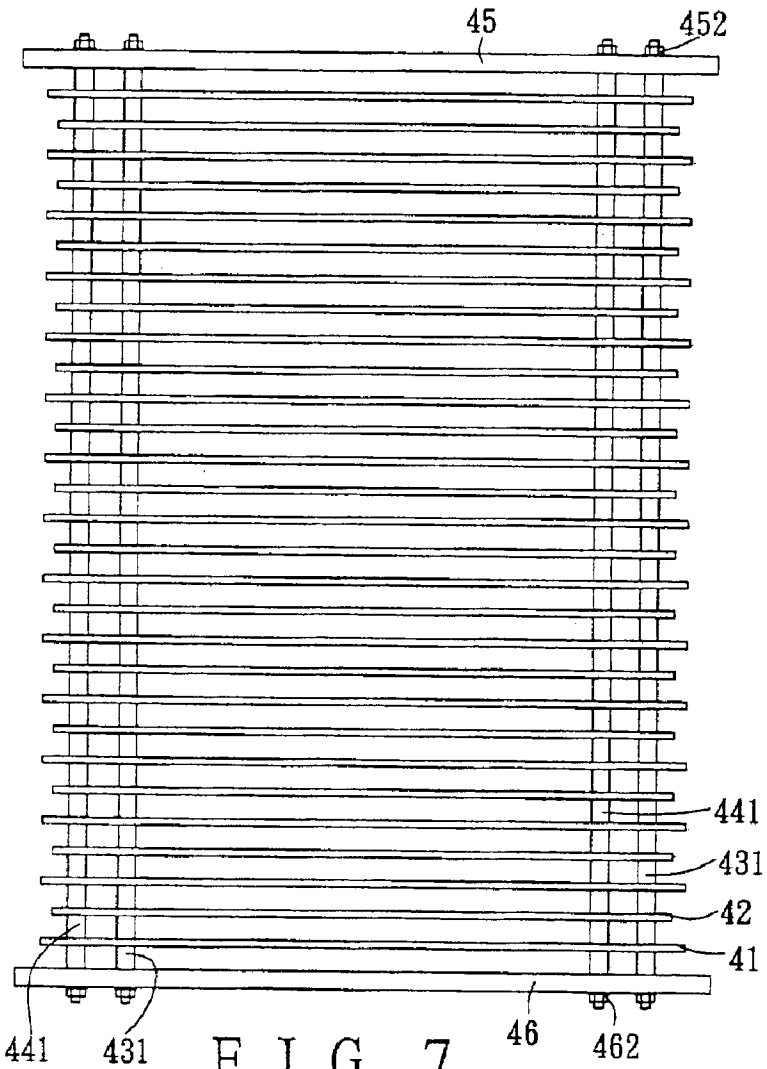
FIG. 7 (PRIOR ART)
FIG. 7 is a side view of the conventional electrostatic precipitator as described in the Background.

Referring to FIGS. 5, and 6, each connectable part 3 of supporting rods according to the second embodiment is formed with threads 311 on an insertion end portion 31 thereof, and threads 321 around a connecting hole 32 of a hollow holding portion thereof for allowing the insertion end portion 31 to be screwed into; thus, the connectable parts 3 of each supporting rod can be joined together more firmly.

From the above description, it can be easily understood that the electrostatic precipitator of the present invention is comprised of supporting rods, which consist of single form of connectable parts 3, therefore it is simpler in the structure, easier to manufacture, and less labor-costing to assemble as compared with the conventional electrostatic precipitator in the Background.

What is claimed is:

1. An improvement on an electrostatic precipitator, comprising a frame including top and bottom board parts, and vertical rod part securely joined to the top and the bottom board parts;

a plurality of first kind of metallic boards equidistantly spaced apart between the top and the bottom board parts of the frame; the first kind of metallic boards having a plurality of big through holes, and a plurality of small through holes thereon;

second kind of metallic boards equidistantly spaced apart between the top and the bottom board parts of the frame, and each positioned between two adjacent ones of the first kind of metallic boards; the second kind of metallic boards having a plurality of big through holes, and a plurality of small through holes thereon; the big holes of the second kind of metallic boards being aligned with corresponding small holes of the first kind of metallic boards; the small holes of the second kind of metallic boards being aligned with corresponding big holes of the first kind of metallic boards; and a plurality of dividable supporting rods joined to both the top and the bottom board parts of the frame at two ends thereof, and passed through corresponding through holes of the metallic boards so as to support the metallic boards equidistantly spaced apart in position; and being characterized by:

each dividable supporting rod being made of a plurality of connectable parts; each of the connectable parts being formed with an insertion end portion at one end, and a hollow holding end portion at other end thereof; each dividable supporting rod being assembled by means of tightly fitting insertion end portions of connectable parts to adjacent hollow holding end portions thereof; the insertion end portions being formed so as to be capable of being tightly passed through the small through holes of the metallic boards; the supporting rods being formed with such a size as to be apart from edges of corresponding big through holes of the metallic boards; thus, the metallic boards being spaced apart and firmly held in position by means of tops of hollow holding end portions of those connectable parts that are joined to small through holes thereof.

2. The electrostatic precipitator as claimed in claim 1, wherein each insertion end portion of the supporting rods is formed with threads on an outer side while each hollow holding end portion of the supporting rods is formed with threads on an inner side.

* * * * *